US007363980B2

(12) United States Patent
Pringle

(10) Patent No.: US 7,363,980 B2
(45) Date of Patent: Apr. 29, 2008

(54) DOWNHOLE FLOW CONTROL APPARATUS, OPERABLE VIA SURFACE APPLIED PRESSURE

(75) Inventor: Ronald E. Pringle, Houston, TX (US)

(73) Assignee: Absolute Oil Tools, L.L.C., Cypress, TX (US)

( * ) Notice: Subject to any disclaimer, the term of this patent is extended or adjusted under 35 U.S.C. 154(b) by 237 days.

(21) Appl. No.: 11/409,315

(22) Filed: Apr. 20, 2006

(65) Prior Publication Data

US 2007/0187107 A1 Aug. 16, 2007

Related U.S. Application Data

(60) Provisional application No. 60/673,500, filed on Apr. 22, 2005.

(51) Int. Cl.
*E21B 34/14* (2006.01)
*E21B 34/08* (2006.01)

(52) U.S. Cl. ..... 166/319; 166/323; 166/332.8; 166/386

(58) Field of Classification Search ..... 166/319, 166/321, 332.8, 331
See application file for complete search history.

(56) References Cited

U.S. PATENT DOCUMENTS 3,986,554 A * 10/1976 Nutter ..... 166/319
4,467,867 A * 8/1984 Baker ..... 166/188
4,926,945 A 5/1990 Pringle et al.
4,991,624 A * 2/1991 Fowler et al. ..... 137/594
5,861,562 A 1/1999 Pringle et al.
5,996,687 A * 12/1999 Pringle et al. ..... 166/66.6
6,070,608 A 6/2000 Pringle
6,237,683 B1 5/2001 Pringle et al.
6,241,015 B1 * 6/2001 Pringle et al. ..... 166/66.4
6,450,541 B1 * 9/2002 Bakke ..... 285/2
6,732,803 B2 * 5/2004 Garcia et al. ..... 166/373
7,246,668 B2 * 7/2007 Smith ..... 166/386
7,270,191 B2 * 9/2007 Drummond et al. ..... 166/386
2003/0079880 A1 * 5/2003 Deaton et al. ..... 166/332.8
2004/0007365 A1 * 1/2004 Hill et al. ..... 166/386
2006/0157255 A1 * 7/2006 Smith ..... 166/374
2007/0137869 A1 * 6/2007 MacDougall et al. ..... 166/386
2007/0215352 A1 * 9/2007 Shaw et al. ..... 166/292
2007/0227738 A1 * 10/2007 Dennistoun et al. ..... 166/316

* cited by examiner

*Primary Examiner*—David J. Bagnell
*Assistant Examiner*—John M Deboer
(74) *Attorney, Agent, or Firm*—Law Office of Jesse D. Lambert, L.L.C.

(57) ABSTRACT

Flow control apparatus, for placement in a downhole location in the tubing string of a well. The apparatus comprises a valve element and a lock element. Application and removal of annulus pressure (on the annulus between the tubing and the casing) permits the apparatus to be cycled between a sensitive-to-flow mode, in which it opens to permit fluids to be injected down the tubing into a subsurface formation, but closes to prevent fluid backflow from the subsurface formation into the tubing; and an insensitive-to-flow mode, in which the apparatus is open to permit unimpeded fluid flow in either direction.

4 Claims, 13 Drawing Sheets

SECTION D-D

SECTION A-A

SECTION C-C

SECTION B-B

DOWNHOLE FLOW CONTROL APPARATUS, OPERABLE VIA SURFACE APPLIED PRESSURE

CROSS REFERENCE TO RELATED APPLICATIONS

This regular patent application claims priority to provisional patent application Ser. No. 60/673,500, filed Apr. 22, 2005.

BACKGROUND

1. Field of the Invention

This invention relates generally to apparatus for downhole placement in a wellbore, to control fluid flow through the wellbore. With further specificity, this invention relates to a type of flow control apparatus, particularly suitable for placement in injection wells (that is, wells in which the primary mode of operation is injecting of fluids into a downhole formation), and which can be cycled through different operating modes by application and release of annulus pressure at the surface of the well.

2. Related Art

Subterranean boreholes, referred to in this application as "wells," have long been drilled for the production of oil and gas. Wells typically comprise a relatively large diameter tubular string, called casing, which is cemented in a borehole drilled into the earth, into which is run a relatively small diameter tubular string, called tubing, through which fluids either flow from the well, or are injected into the well. As a matter of terminology herein, the term "tubing" refers to the tubular string through which fluid flow (whether production or injection) occurs.

Wells are also used for injection purposes; that is, instead of flowing fluids (oil, gas, and formation water) out of a subsurface formation and up through the tubing to the surface, injection wells are used to inject fluids from the surface down the tubing into a subsurface formation. Fluid injection may be used as a means of disposing of produced water (which, in some cases, cannot be discharged into a surface environment, due to regulatory requirements), and/or as a means of oil and gas production enhancement, by providing a means of formation pressure support.

A fundamental requirement for injection wells is that some form of flow control apparatus be in place to prevent fluid flow from the formation upward into the tubing, when such flow is not desired. It is important to understand that such flow, known as "backflow" to distinguish it from injection, is at times necessary. For example, although fluids being injected (typically, produced water) is processed so as to reduce solids content, often some small amount of solids remain in the fluid stream. At very high injection rates (thousands of oil field barrels per day), such solids can cause problems by partially blocking the formation into which the fluids are being injected. This is noted by increases in required injection pressures. To reverse this undesired condition, the injection well may be permitted to backflow, so that fluids flowing out of the formation will carry with them the objectionable solids, thereby cleaning the injection path.

While fluid flow can be controlled from the surface of the well, problems arise. A wellbore many thousands of feet deep correspondingly has a fluid column many thousands of feet long. When fluid backflow is ongoing, stopping the fluid column at the surface (that is, near the end of its path of travel) can give rise to what is commonly known as the "water hammer" effect. For this and other reasons, particularly (although not exclusively) in injection wells, especially in a flowback condition, fluid flow is preferably controlled by a flow control apparatus near the source of the flow—that is, one located in the tubing downhole, near the bottom of the well.

Various devices for certain types of subsurface fluid flow control are well known in the art, commonly referred to as Surface Controlled Sub Surface Control Valves, or SCSSVs. Such valves are primarily for safety purposes, to provide a means of shutting in producing oil and gas wells if surface controls fail. SCSSVs are typically run in the tubing relatively near the surface of the well, on the order of 1000 feet deep or less, and are controlled by a hydraulic control line run in the tubing/casing annulus, from the valve to the surface. The known art SCSSV design cannot be selectively placed into operating modes which are either sensitive to fluid flow, or insensitive to fluid flow.

There is, therefore, a need for a fluid flow control apparatus adapted to incorporated into a tubing string and placed downhole in a well, if desired many thousands of feet from the surface, and which can be controlled by the surface application of and removal of pressure, whether on the annulus (that is, the annulus between the tubing and casing) of the well or pressure applied via a control line run from the surface downhole to the apparatus. Application and removal of pressure from the surface of the well permits the apparatus to be placed into one of two modes: a sensitive-to-flow mode, in which the apparatus opens in response to fluids being injected, thereby permitting fluid injection, but closes to prevent fluid backflow; and an insensitive-to-flow mode, in which the apparatus is open and permits fluid injection and backflow. The present invention therefore lends itself to operation either by annulus pressure or control line pressure.

DESCRIPTION OF THE PRESENTLY PREFERRED EMBODIMENT(S)

With reference to the drawings, some of the presently preferred embodiments of the present invention can now be described. It is to be understood that various changes can be made to the invention, without departing from the scope thereof. It is to be further understood that the scope of the invention covers use thereof in any sort of well, e.g. whether production wells or injection wells.

Broadly speaking, the apparatus may be best understood by considering it as having two broad elements: (1) a valve, comprising a flow tube and flapper; and (2) a lock, comprising a piston responsive to downhole pressure differential (selectively caused by annulus pressure controlled from the surface of the well), and an indexer operatively linked to the piston. The indexer shoulders against the flow tube, so that when the indexer is in a downward position, the flow tube is positively held in said downward position (and as a result, the flapper is blocked open).

It is to be understood that references to "upward" mean toward the surface of the well, and "downward" mean toward the bottom of the well. It is to be further understood that in a typical application the apparatus is made up into a tubing string, and run downhole to a desired subsurface position, typically thousands of feet from the surface of the well. Consequently, there is fluid both within the tubing and interior of the apparatus, and also fluid in the annulus between the tubing and the casing and the apparatus and the casing. It is to be understood that in order for the tool to be operated, it is important to have the same fluid type (e.g. hydrostatic column) in both the annulus and tubing.

Valve Element

Figure 1:
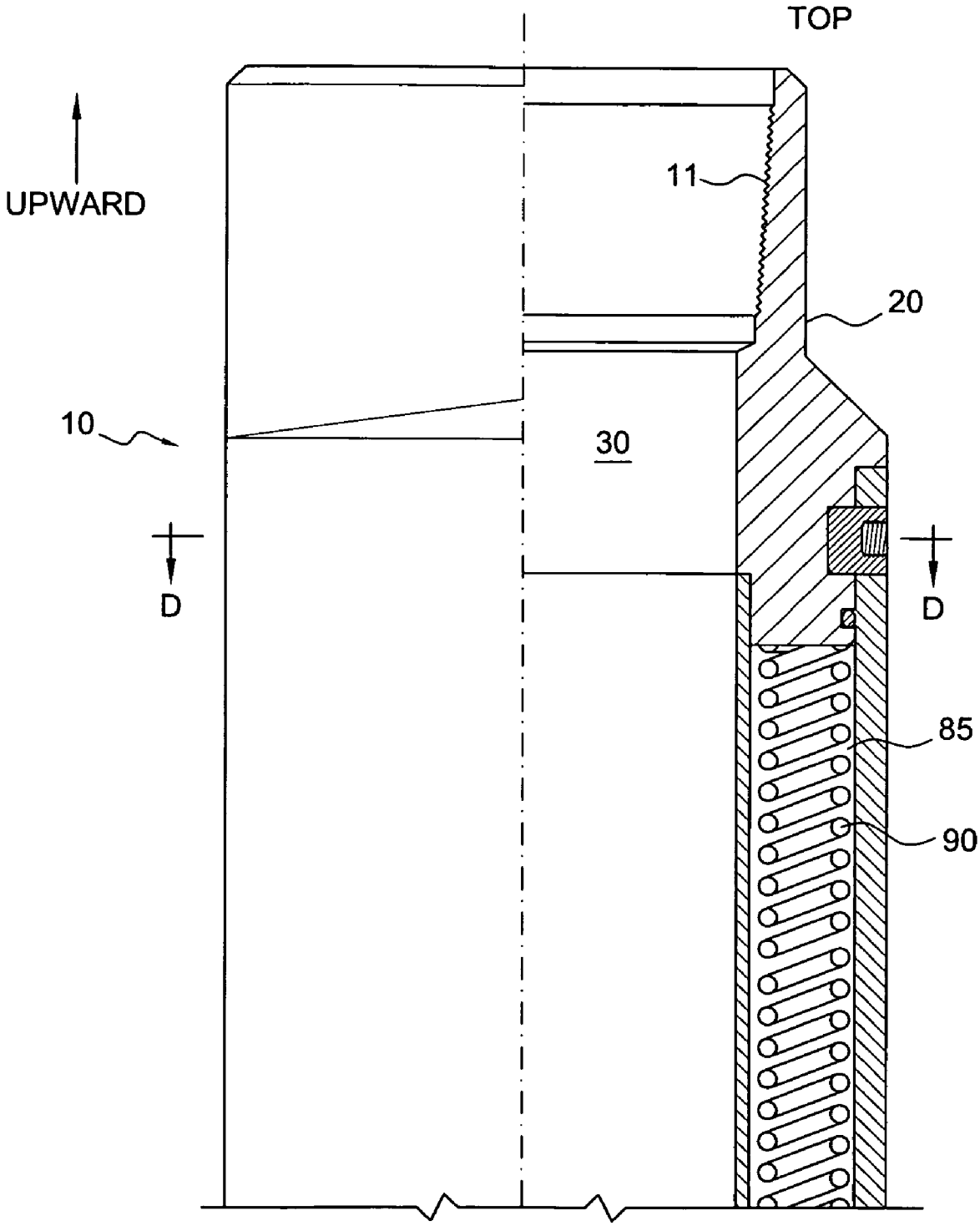
FIGS. 1-5 comprise an overall, detailed view of the apparatus in partial cross section; it is to be understood that in order to provide desired structural detail, the overall drawing is segmented, working from the top of the tool in FIG. 1, in sequence, through the bottom of the tool in FIG. 5.
Figure 2:
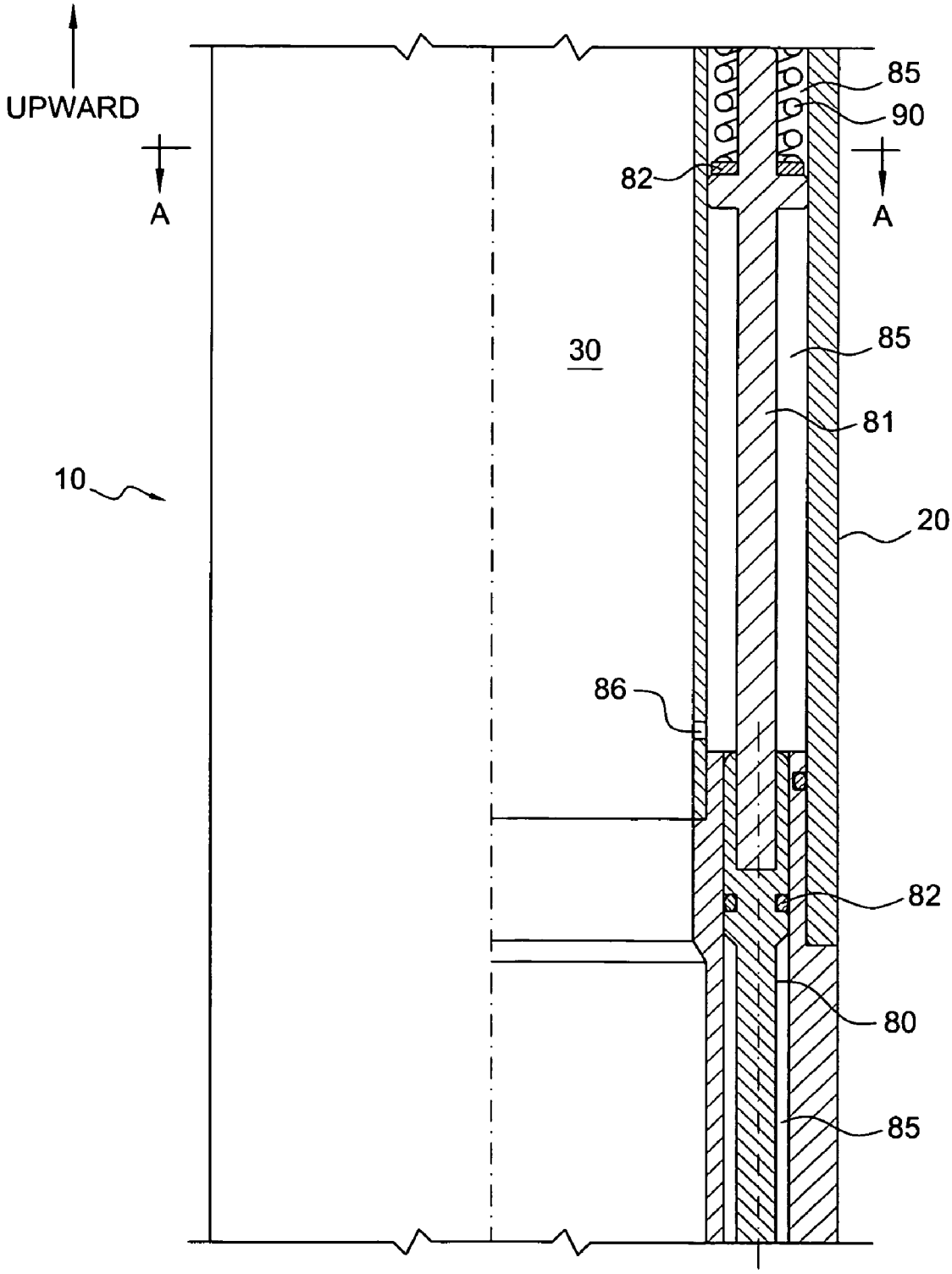
Figure 3:
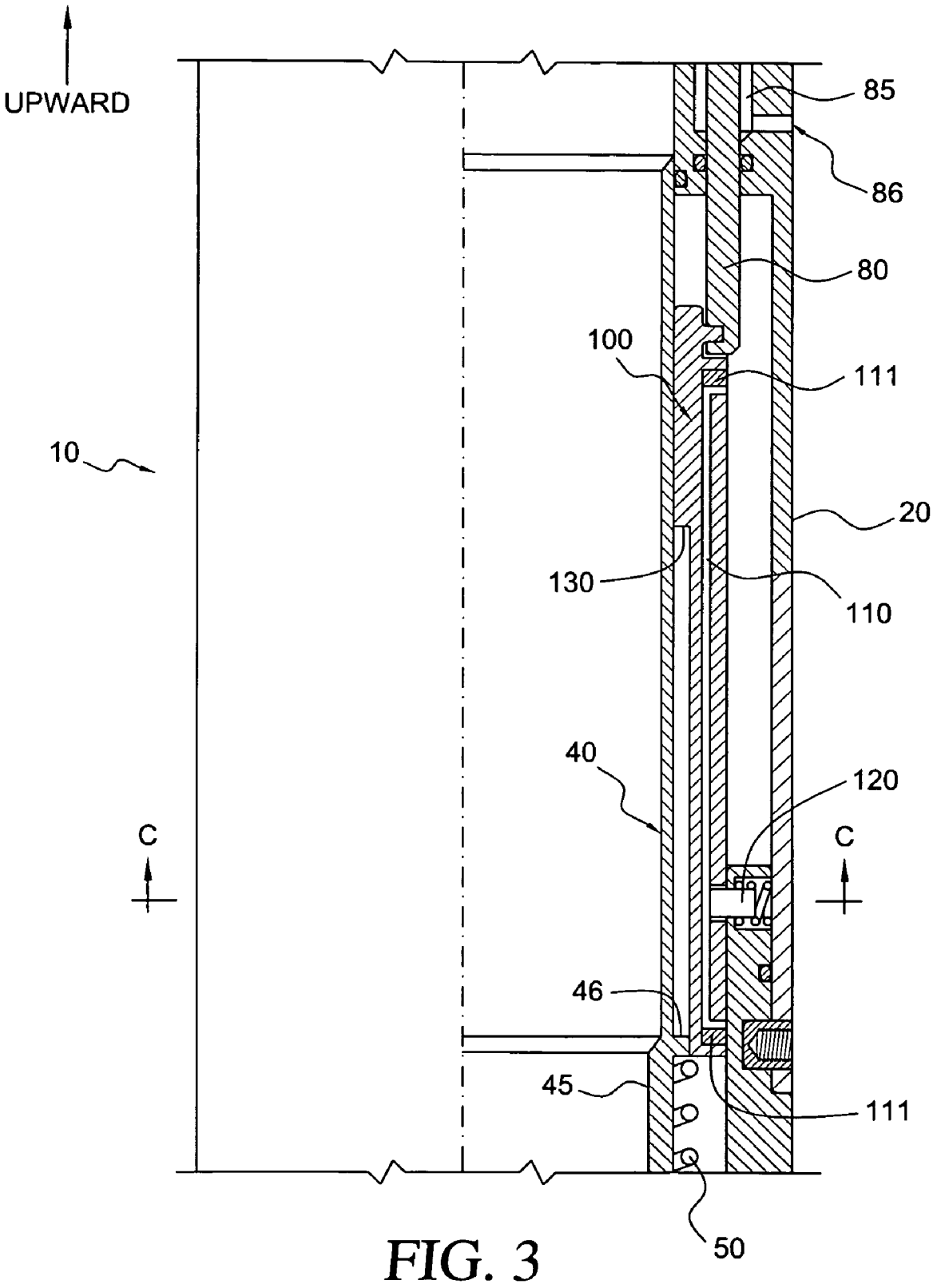
Figure 4:
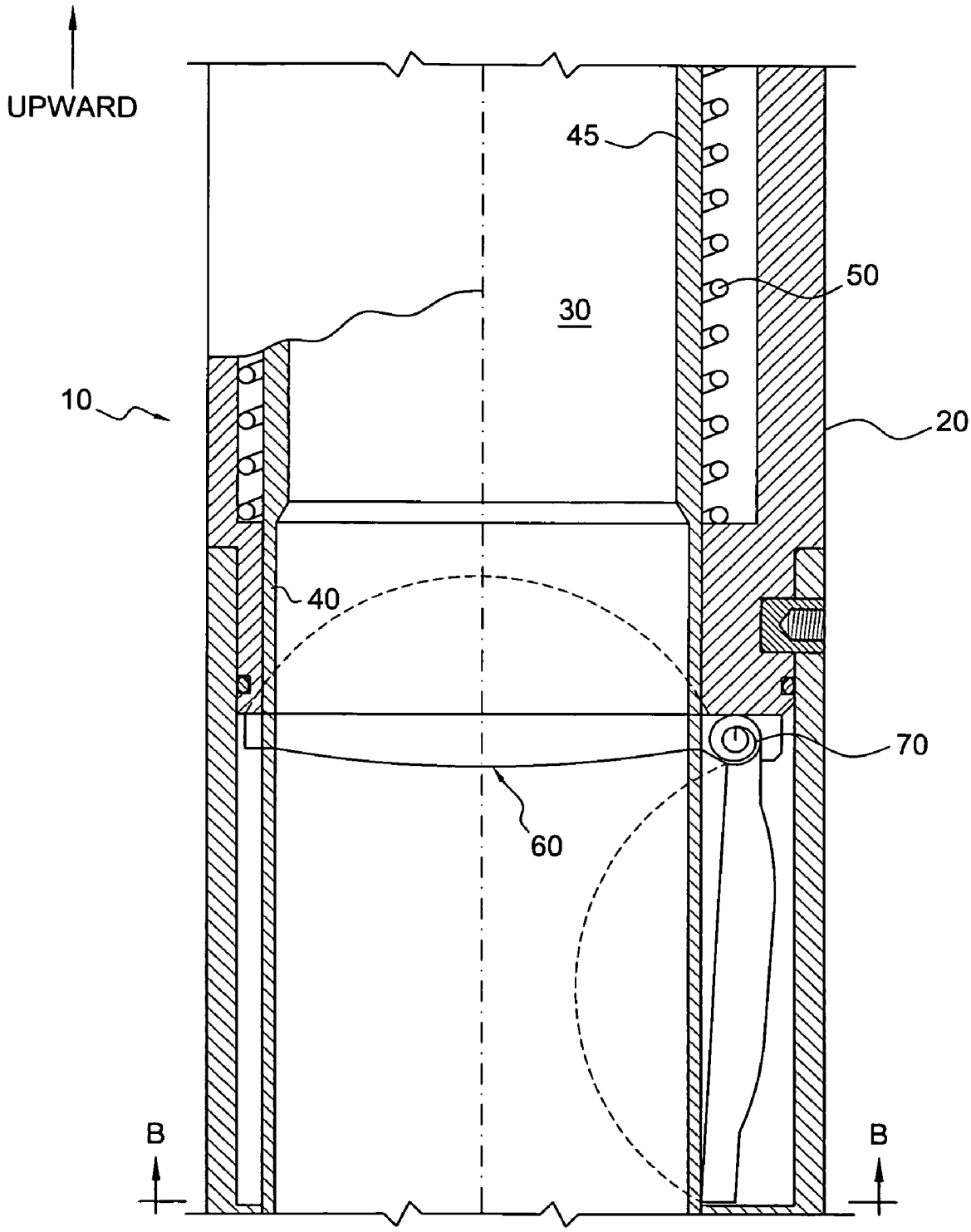
Figure 5:
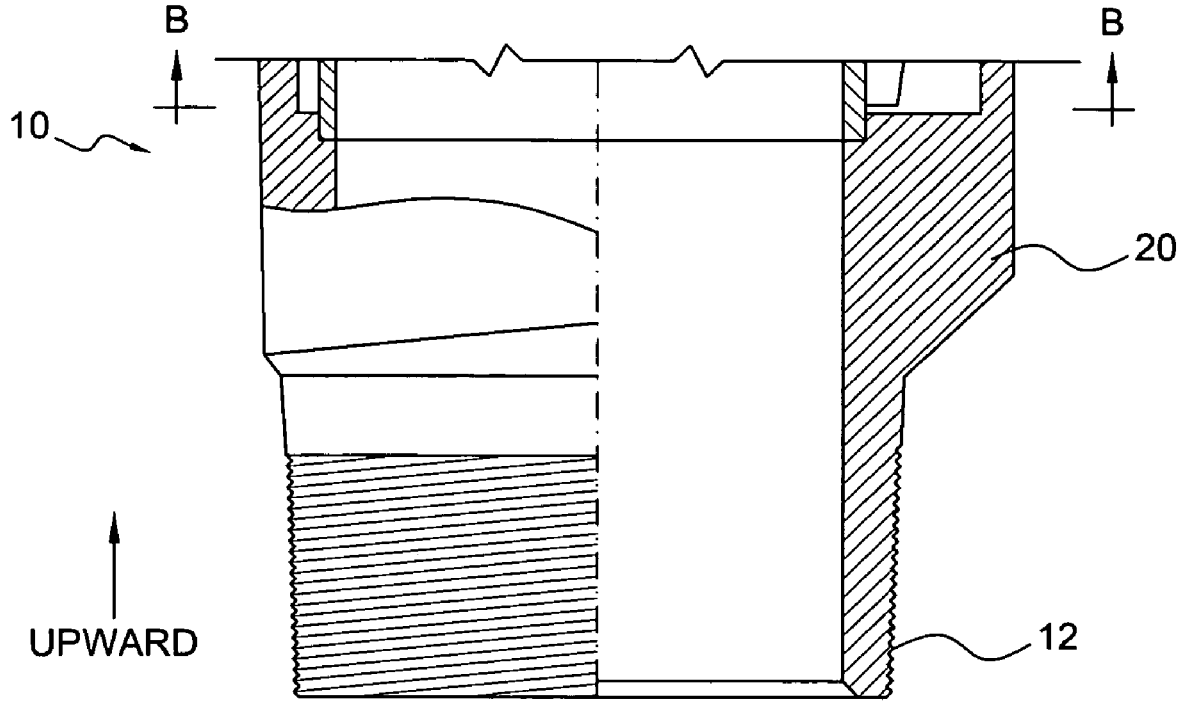
Figure 9:
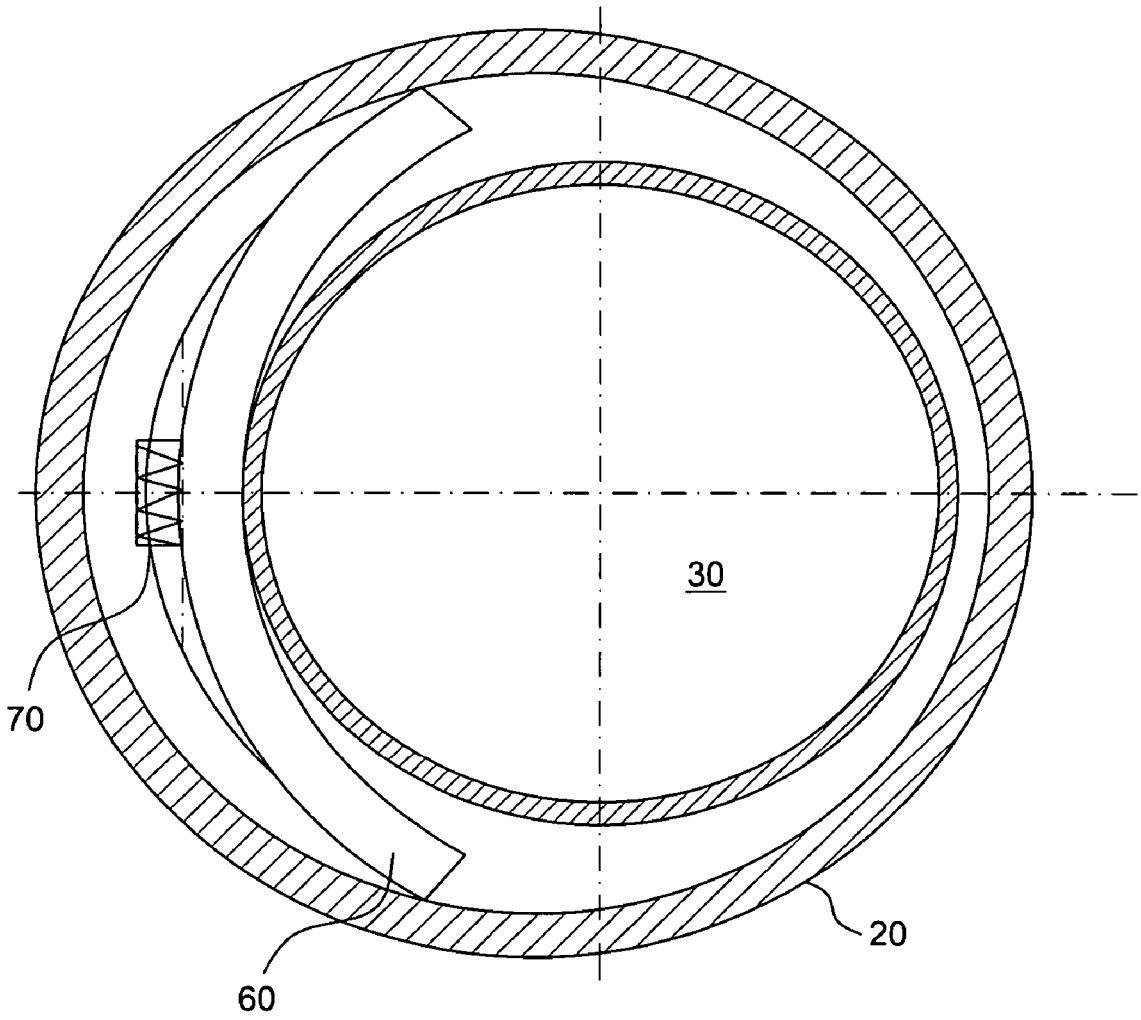

Overall, the flow control apparatus 10 comprises an elongated outer housing 20 with a bore 30 therethrough. Threaded connections 11 and 12 are provided at either end of the apparatus, so that it can be made up into a string of tubing. The valve element comprises a longitudinally movable flow tube 40 mounted in bore 30, which is biased by flow tube spring 50 in an upward direction. A flapper 60 is hinge mounted below flow tube 40, so that it can rotate between two positions: a first or open position, where flapper 60 is rotated out of the path of bore 30; and a second or closed position (flapper 60 tends to be rotated to the second position by a flapper spring 70), where flapper 60 blocks the path of bore 30, and prevents fluid flow back up the tubing. Flapper 60, in a presently preferred embodiment, is of the type known as a "curved flapper," rather than a flat flapper, as can be seen in the figures, especially FIGS. 4 and 9. It is to be understood, however, that the scope of the invention encompasses any shape flapper, whether flat or curved.

Lock Element

Figure 7:
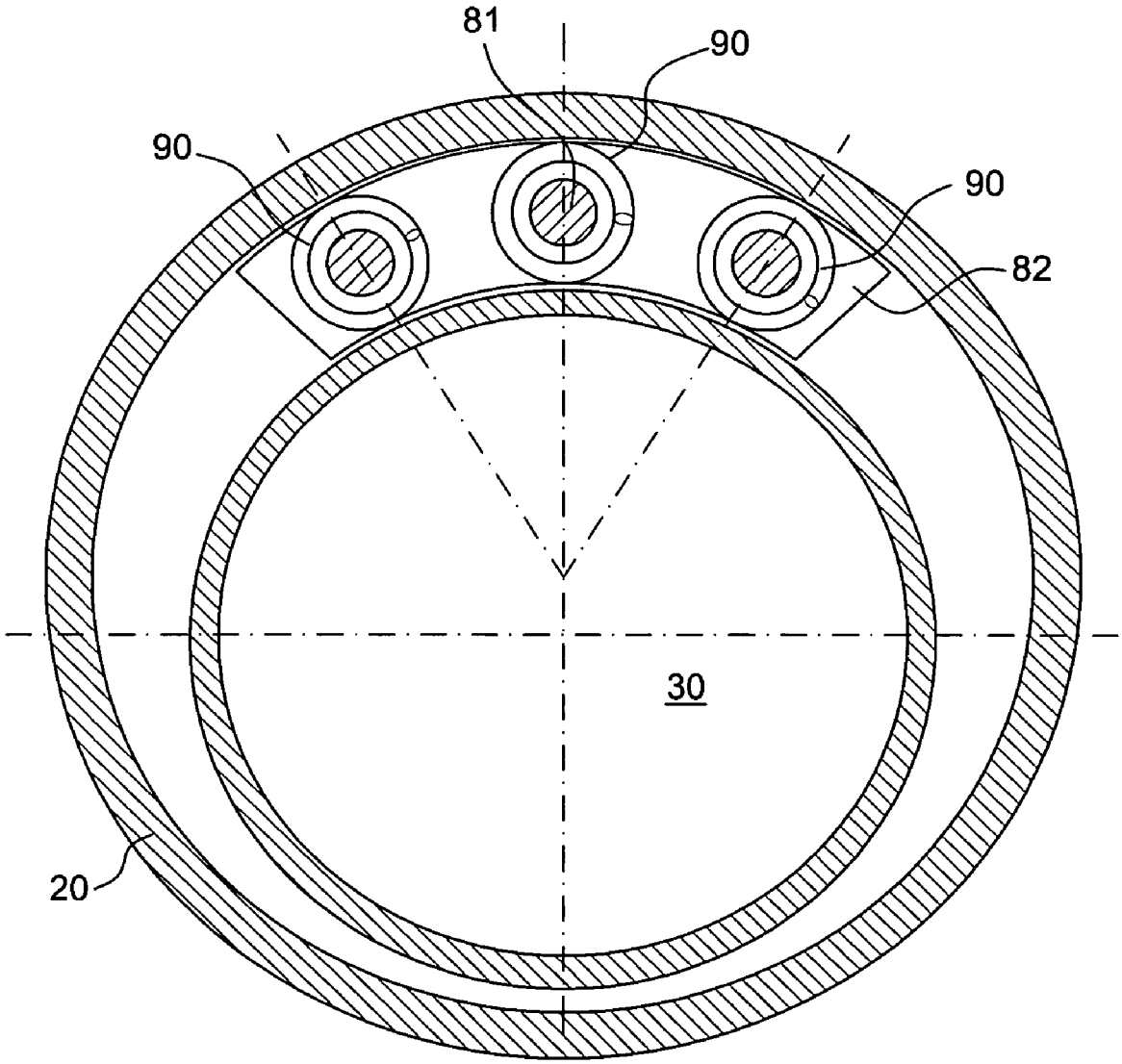
Figure 8:
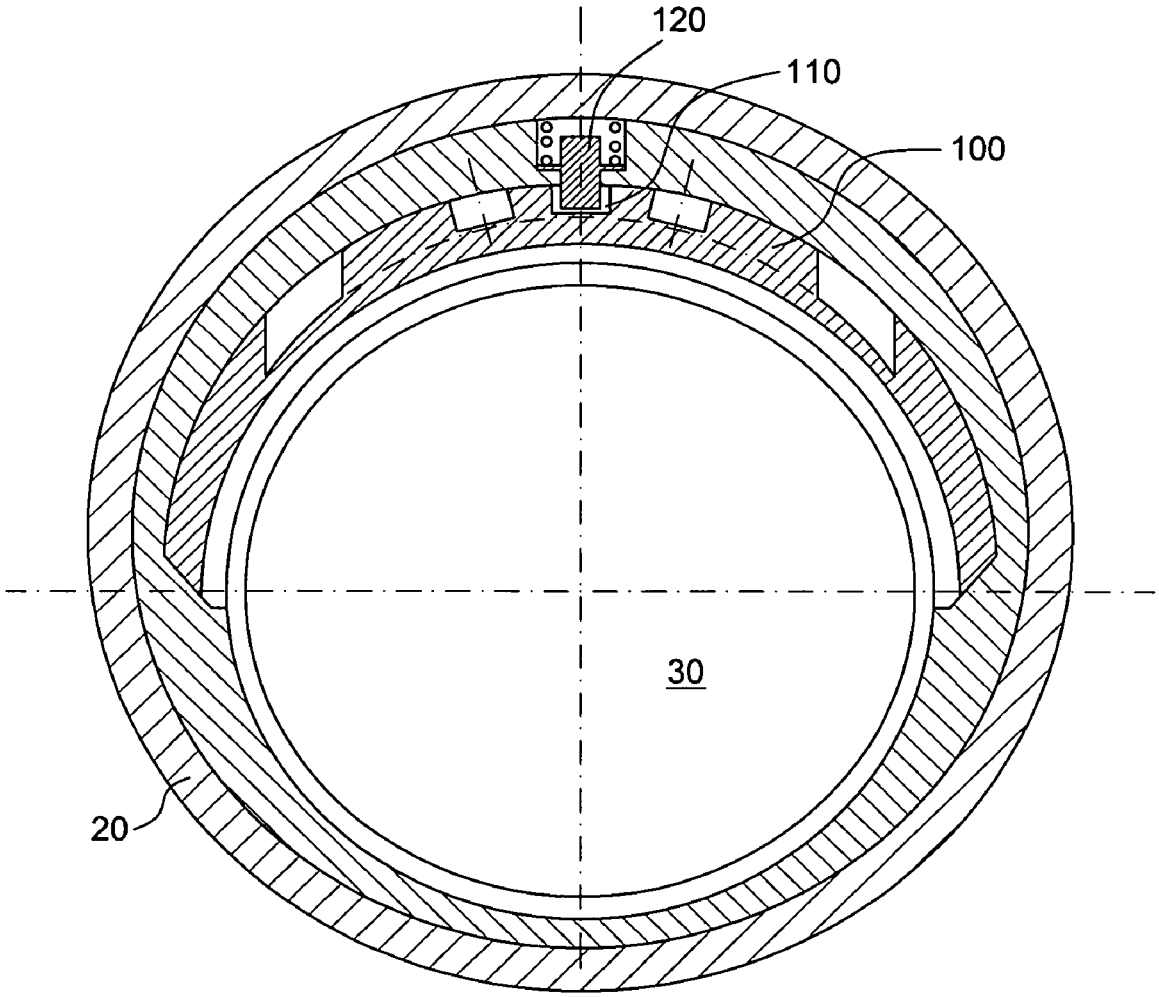
Figure 10:
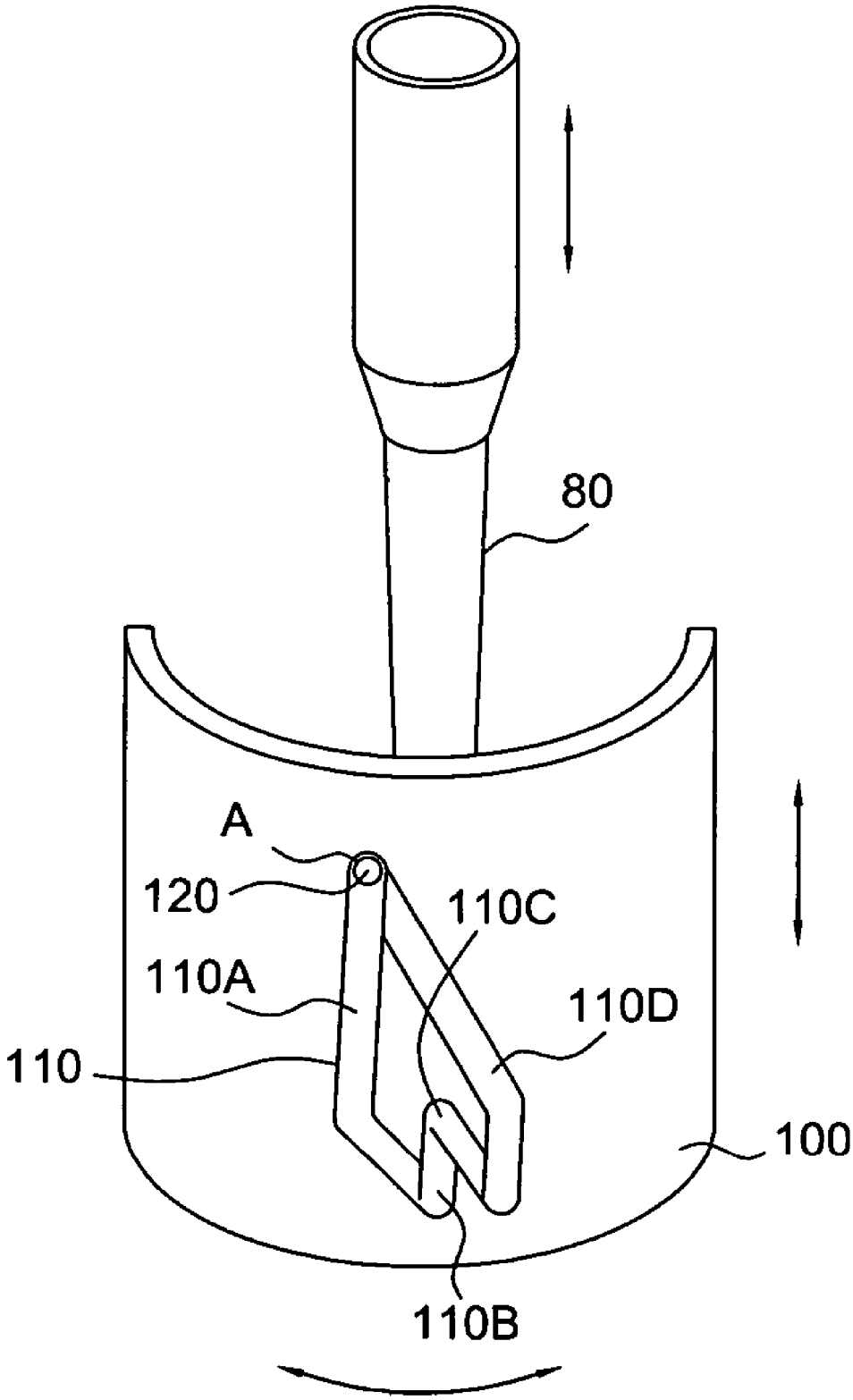
FIG. 10 is a detailed view of the indexer and piston, showing especially the indexer groove.
Figure 11:
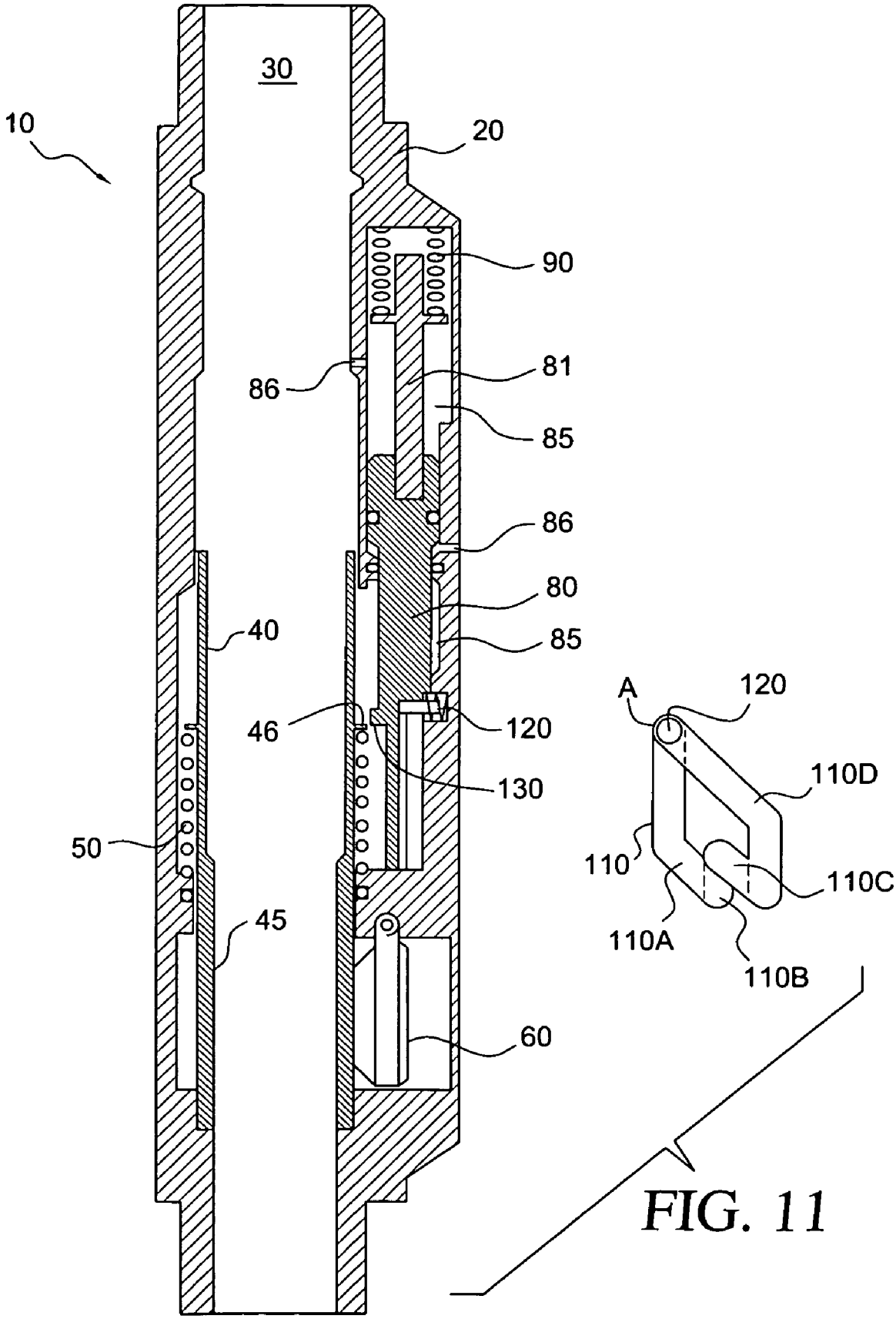
FIG. 11 is a simplified cross section of the apparatus, with the apparatus in the insensitive-to-flow position.

The lock element comprises a longitudinally reciprocable piston 80 disposed in a chamber 85, which is positioned eccentric to bore 30 within outer housing 20. FIGS. 1-4 include cross sections of outer housing 20 showing the position of chamber 85. A piston spring 90 biases operating rod 81, and in turn piston 80, toward a downward position. Piston 80 has seals 82 as appropriate. Piston 80 is connected to an indexer 100, which is structurally an elongated segment of a tubular wall (spanning roughly 90 degrees of curvature), having a groove 110 cut into the outer surface thereof. Bearings 111 may be provided. In a presently preferred embodiment, as seen in FIG. 7, three springs 90 bear against plate 82, which in turn bears against operating rod 81. FIG. 10 is a detailed view of indexer 100, and especially groove 110. FIG. 8 is a cross section showing the curved cross sectional shape of indexer 100, and also groove 110 and spring biased pin 120. Groove 110 fits over a spring biased pin 120 mounted in the outer housing (the pin being spring biased so as to always press against the floor surface of groove 110). Indexer 100 can move longitudinally (coupled to piston 80), and rotationally, within structural confines of the tool.

Indexer groove 110 comprises several distinct groove segments 110A-110D, as can be readily seen in FIG. 10, along which indexer 110 moves in sequence, with the floor surface of each groove segment being at different levels, or "stairstepped," so that indexer 110 cannot reverse itself (i.e. once indexer 110 moves so that pin 120 moves down to the next groove segment floor, indexer 110 cannot return to the preceding groove segment unless without moving through the remaining sequence of groove segments). The path of the indexer groove segments, and the stairstep aspect, enables the apparatus to be cycled through its two operating modes by the application and release of annulus pressure, at the surface of the well, in a defined pressure sequence.

Operating Modes of the Apparatus: Sensitive-to-Flow and Insensitive-to-Flow

In a first operating mode, or sensitive-to-flow mode, the valve element operates substantially free from influence from the lock element (in this mode, piston 80, and consequently indexer 100, is in an upward position, as described in detail below), and will open and close with the presence or absence of fluid flow in a downward direction. As fluid is pumped downhole, flapper 60 will first be urged open by fluid pressure. Flow tube 40 contains a section of reduced inner diameter 45. Fluid flow through flow tube 40 in a downward direction, due to the "choke effect" from the section of reduced inner diameter 45, creates a downward force on flow tube 40, which overcomes the force from flow tube spring 50, forces flow tube 40 downward, and in turn contacts and rotates flapper 60 out of the path of bore 30, to its first or open position. Increased fluid flow continues to force flow tube 40 downward, forcing flapper 60 to rotate to its fully open position. However, should fluid flow in a downward direction cease, the resulting force on flow tube 40 ceases, flow tube 40 is moved upward by flow tube spring 50 and out of engagement with flapper 60, and flapper spring 70 will rotate flapper 60 to its closed position. Fluid flow in an upward direction is then prevented. As can be seen, in this operating mode whether the valve is open or closed depends upon whether fluid is flowing therethrough, hence the term "sensitive-to-flow."

In a second operating mode, or insensitive-to-flow mode, flow tube 40 is positively held in its downward position (as opposed to being held in the downward position only by fluid flow forces), and as a result flapper 60 is rotated out of the path of bore 30 and the valve is "locked open," regardless of presence or absence of fluid flow or direction of same. In this mode, the valve element is not independent of the lock element, but instead is controlled by it. Piston 80 is forced downward by piston spring 90, and consequently indexer 100 is also forced to a downward position. A shoulder 130 on the inner surface of indexer 100 engages a shoulder 46 on the outer surface of flow tube 40, forcing flow tube 40 to its downward position, thereby holding flapper 60 open as described above.

It is therefore the position of indexer 100 which fundamentally determines whether the apparatus is in the sensitive-to-flow or insensitive-to-flow mode.

A description of the movement and position of the various parts of the apparatus as it is cycled between its two operating modes brings operation of the apparatus into focus. It is to be understood that the apparatus may be cycled between its two operating modes by the application and release of annulus pressure from the surface of the well, and may be so cycled a substantially unlimited number of times. FIGS. 10-13 are especially helpful in explaining the sequence of operation.

While Running into the Wellbore (Insensitive-to-Flow Mode)

During this phase, the valve element must be open so that fluid may flow freely into the tubing. The apparatus must therefore be in the insensitive-to-flow mode, as described above, and as shown in FIG. 11. It is understood that FIGS. 11-13 include insert drawings of groove 110, along with the position of pin 120 within said groove. In such mode, piston 80 and indexer 100 are in a downward position (under the influence of piston spring 90), shoulder 130 on indexer 100 bears against shoulder 46 on flow tube 40 also holding it in a downward position, and flapper 60 is rotated to its open position and blocked from movement by flow tube 40. It is further understood that indexer 100 is in its starting position, with the indexer pin at point A in groove segment one 110A. For reference, FIG. 10 also shows the position of pin 120 in groove 110 (namely, at the upper end of groove segment one 110A), corresponding to the position shown in FIG. 11.

During Normal Injection Operations (Sensitive-to-Flow Mode)

Figure 12:
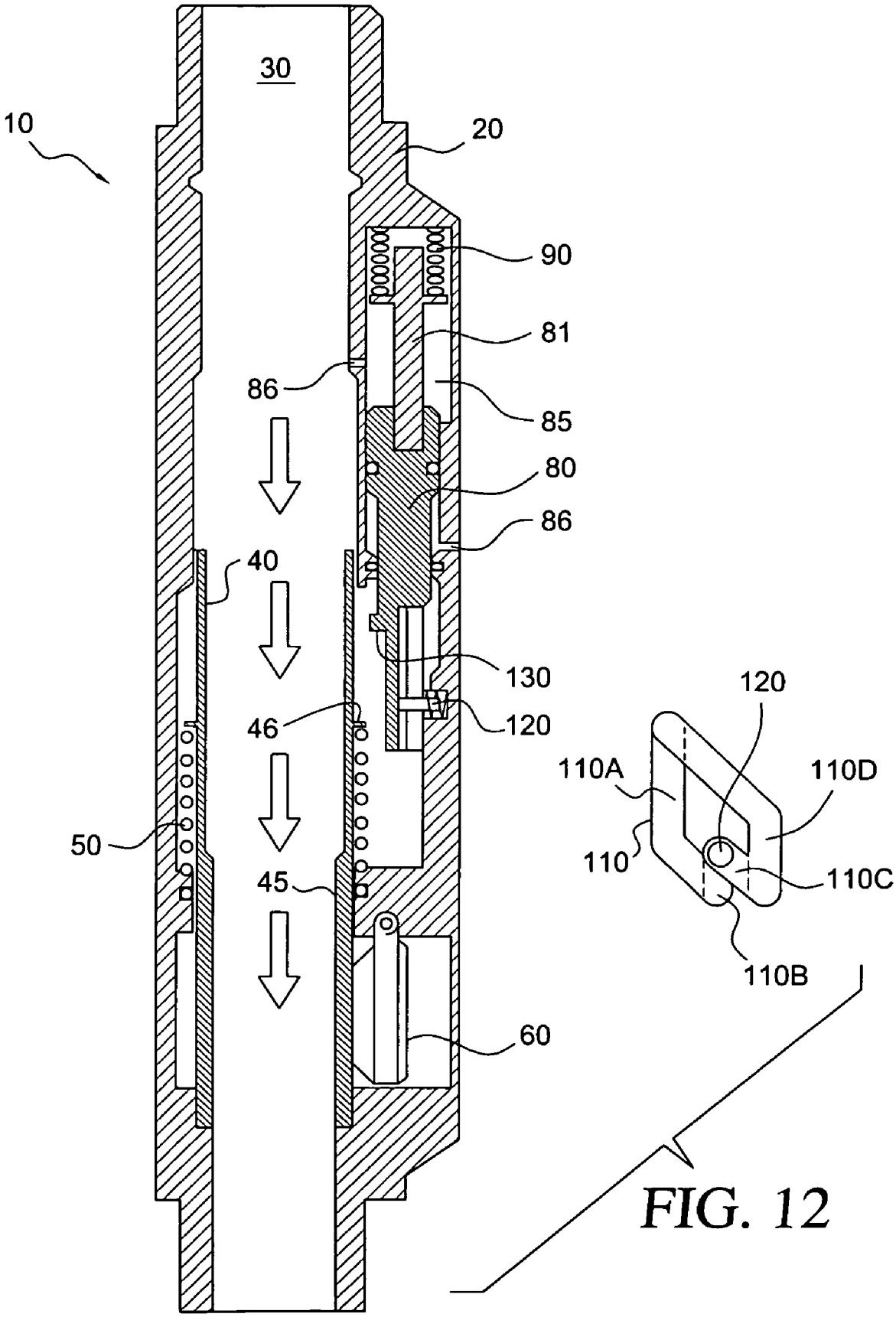
FIG. 12 is a simplified cross section of the apparatus, with the apparatus in the sensitive-to-flow position, with the valve open and with downward fluid flow (injection) ongoing.
Figure 13:
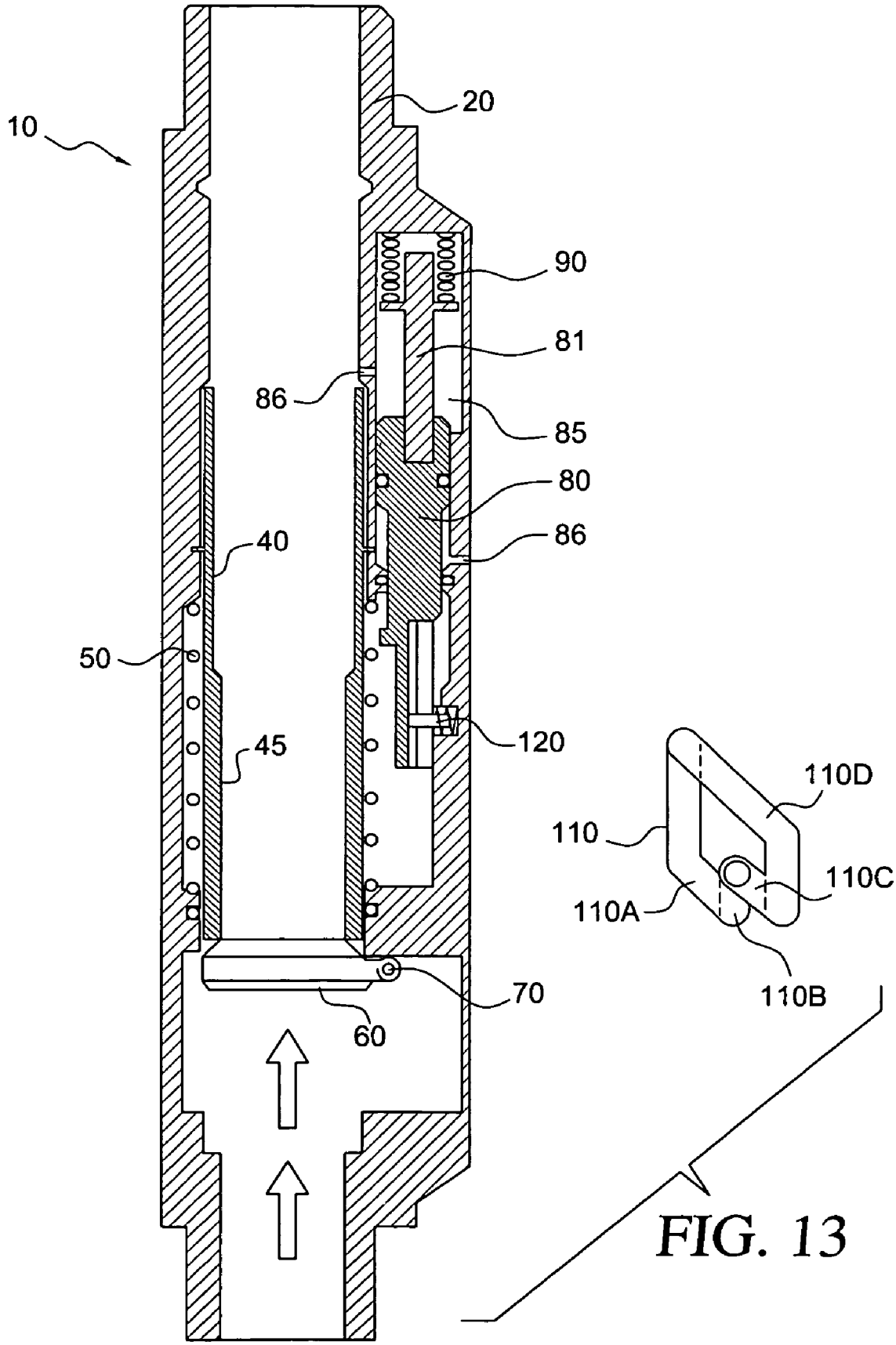
FIG. 13 is a simplified cross section of the apparatus, with the apparatus in the sensitive-to-flow position, with the valve closed, preventing upward flow.

Once the apparatus is in the desired downhole location (i.e. set at the proper depth), it may be placed in the sensitive-to-flow mode. FIG. 12 shows the apparatus in this position. This is done by applying a predetermined annulus pressure at the surface of the well, thereby creating a downhole pressure differential between the outside of the apparatus and the bore of the apparatus. Ports 86 in chamber 85 permit tubing pressure to act on the upper side of piston 80, and annulus pressure to act on the under side of piston 80; a pressure differential thus acts on piston 80, such that the lower tubing pressure is imposed on the upper side of the piston, and the higher annulus pressure is imposed on the underside of the piston. The net effect is to overcome the force of piston spring 90 and move piston 80 upward. Indexer 100, coupled to piston 80, is also moved upward. Indexer 100 continues to move upward along the path of groove segment one 110A, and pin 120 riding in the groove forces indexer 100 to rotate as the angled portion of groove segment one 110A is reached. Continued upward movement of piston 80 moves indexer 100 to the end of groove segment one 110A, where pin 120 (which, as described above, is spring loaded so as to always bear against the groove floor) is pushed past the stairstep to "fall into" groove segment two 110B.

Then, the annulus pressure at the surface of the well is released. Piston spring 90 forces piston 80, and indexer 100, downward. As constrained by pin 120, indexer 100 moves downward without rotation, a relatively short distance, until pin 120 is pushed past the next stairstep into groove segment three 110C. As can be seen from the figure, the uppermost end of groove segment three 110C rests against pin 120, and indexer 100 is constrained from further downward movement. As such, indexer 100 is held upward, out of engagement with flow tube 40, and the apparatus is therefore in the sensitive-to-flow mode described above. This is the position that the apparatus will typically be in, while injection operations are being conducted in the well.

Cycling Back into the Insensitive-to-Flow Mode

When desired to return the apparatus to the insensitive-to-flow mode, application of annulus pressure at the surface is again used. Applying the predetermined amount of annulus pressure at the surface of the well again creates a differential pressure downhole, which (as described above) overcomes the force of piston spring 90, and forces piston 80 upward. Indexer 100 consequently is forced upward, and at the same time rotates due to pin 120 tracking in groove segment three 110C, until pin 120 is pushed down the next stairstep into groove segment four 110D, at which point indexer 100 is constrained from further upward movement (since the lowermost end of groove segment four 110D cannot move past pin 120).

Next, the annulus pressure is removed, and piston spring 90 is again able to force piston 80, and indexer 100, downward. Indexer 100 moves downward with pin 120 in groove segment four 110D, along the path shown until indexer 100 is moved to the starting position described above, when pin 120 is pushed down the next stairstep to once again fall into groove segment one 110A, in the starting position A as described above. The apparatus is now once again in the position described above, and as shown in FIG. 11, as when running into the wellbore.

It is to be understood that the above described sequence of operation can be repeated as many times as desired, requiring only placing and releasing annulus pressure at the surface of the well.

It is important to note that piston spring 80 (although stronger than flow tube spring 50) is of insufficient strength to overcome a significant pressure differential across flapper 60 (i.e., pressure below the flapper greater than pressure above the flapper). As a result, in the event of a relatively high differential pressure across flapper 60, flow tube 40 will simply be unable to push it (flapper 60) out of the way, but cannot exert enough force on the flapper to shear the pin on which flapper 60 rotates.

Figure 6:
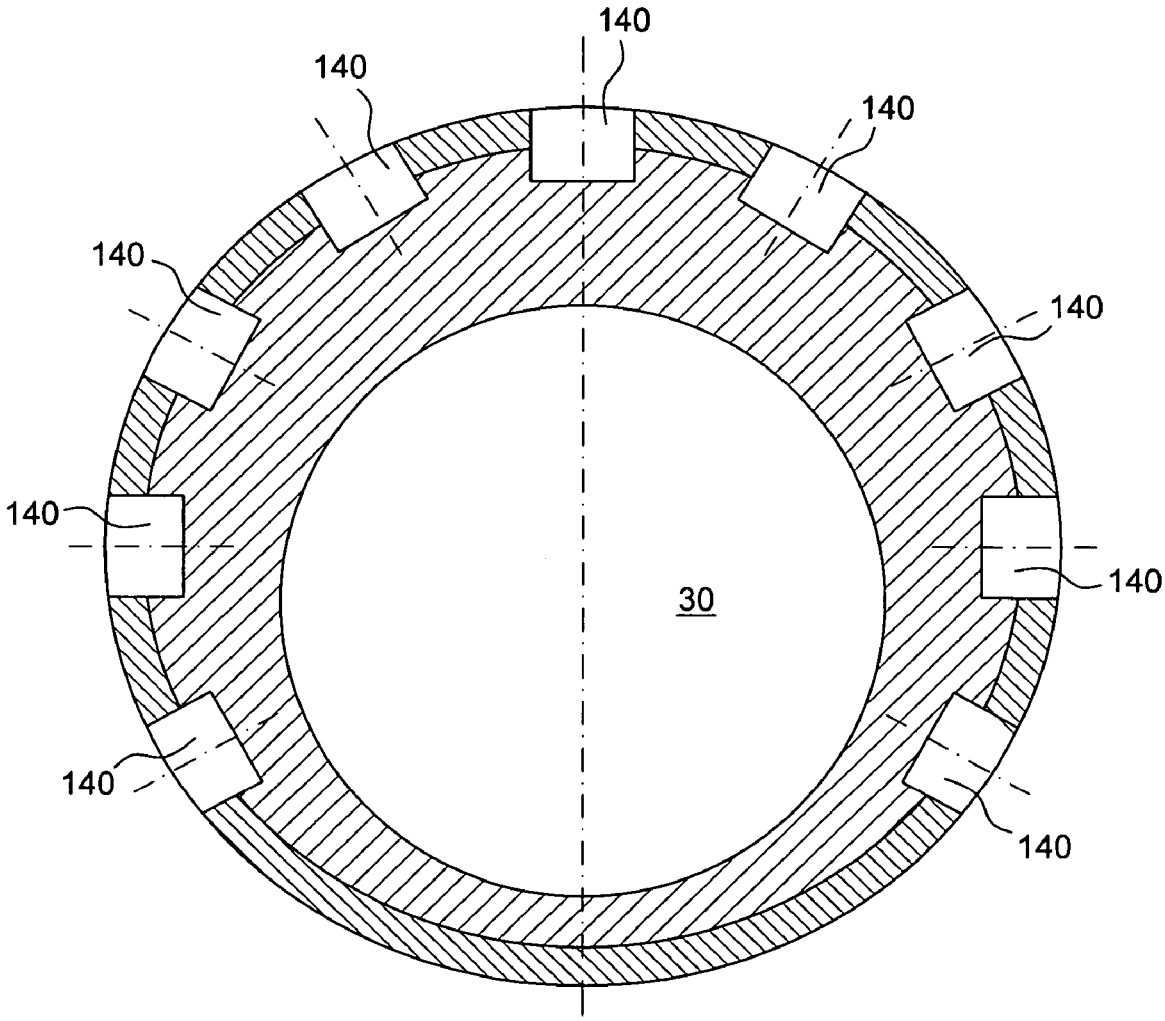
FIGS. 6-9 are cross section views of the tool, corresponding in sequence to cross sections D-D in FIG. 1, A-A in FIG. 2, C-C in FIG. 3, and B-B in FIG. 4.

It is to be understood that the apparatus, particularly the outer housing, may be made up from several segments for ease in assembly of the overall apparatus. In one presently preferred embodiment, the segments of the outer housing are joined by pinned joints (joined by a plurality of pins 140), see FIGS. 1 and 6, rather than threaded joints. The eccentric cross sectional shape makes the pinned connections particularly useful. The pins must provide tensile strength equal to the outer housing tensile strength. It is understood that the location of the pins may be staggered (that is, offset from being in a line around the circumference of the apparatus) for strength purposes. It is further understood that other means of joining the outer housing segments, for example threaded connections known as "timed" threads, could also be used.

With regard to materials, the various components of the apparatus are preferably made of high grade metal alloys (typ. 120 KSI yield strength), as are well known in the relevant art. Seals and the like are made of suitable materials known in the art.

With regard to dimensions, the apparatus (and the components thereof can be sized so as to permit use in different size wellbores, and with different size tubing strings.

While the preceding description contains many specificities, it is to be understood that same are presented only to describe some of the presently preferred embodiments of the invention, and not by way of limitation. Changes can be made to various aspects of the invention, without departing from the scope thereof. For example, dimensions and materials may be varied; the strengths of the springs may be set so as to operate at desired pressures; etc.

Therefore, the scope of the invention is not to be measured by the specific examples given, but by the scope of the appended claims and their legal equivalents.

I claim:

1. A flow control apparatus for incorporation into a tubing of a well, and for downhole placement in within a casing of said well, comprising:

a) an elongated outer housing with a bore, said housing comprising threaded connections at either end for makeup into a string of said tubing;

b) a flow tube disposed in said bore of said outer housing, and a flow tube spring biasing said flow tube in an upward direction toward the surface of said well, said flow tube having a bore with a reduced inner diameter section, said flow tube further having an external shoulder;

c) a flapper hingedly mounted in said housing, and movable between a first position blocking said bore, and a second position rotated out of the path of said bore, and a flapper spring biasing said flapper toward said first position;

d) a reciprocable piston disposed in a chamber in said outer housing, said chamber being eccentric to said bore of said outer housing and having ports which permit pressure within an annulus between said tubing and said casing to act on an underside of said piston, and which permit pressure within said bore to act on an upper side of said piston;

e) a spring disposed in said chamber, biasing said piston in a downward direction toward a bottom of said well;

f) an indexer coupled to and movable longitudinally with said piston, said indexer further movable rotationally, said indexer comprising a groove in the outer surface thereof, said groove comprising a series of connected groove segments, each of said groove segments having a floor surface at a different level from said outer surface, said indexer further having a shoulder engageable with said shoulder of said flow tube;

g) a pin disposed within said outer housing and disposed within said groove, and a spring biasing said pin so as that said pin bears against said floor surfaces, whereby a predetermined pressure within said annulus greater than a pressure within said bore causes a pressure differential across said piston sufficient to move said piston in an upward direction, resulting in upward longitudinal movement of said indexer, and rotational movement of said indexer due to said indexer groove bearing on said pin.

2. The apparatus of claim 1, whereby said groove segments are sized and positioned so as to permit said indexer to be placed in an upward position, thereby preventing said shoulder on said indexer from contacting said shoulder on said flow tube even when no differential pressure exists.

3. The apparatus of claim 2, wherein said flapper comprises a curved flapper.

4. The apparatus of claim 1, whereby said outer housing comprises multiple segments joined by pins.

* * * * *